United States Patent [19]

Baker et al.

[11] Patent Number: 4,569,218

[45] Date of Patent: Feb. 11, 1986

[54] APPARATUS AND PROCESS FOR PRODUCING SHAPED METAL PARTS

[75] Inventors: Robert L. Baker, Cahokia, Ill.; Lester P. Chin, El Toro, Calif.; James A. Courtois, Florissant; Lawrence J. Pionke, St. Charles, both of Mo.; Ralph M. Sharp, Fountain Valley; Peter S. Willcox, Costa Mesa, both of Calif.

[73] Assignee: Alumax, Inc., San Mateo, Calif.

[21] Appl. No.: 512,922

[22] Filed: Jul. 12, 1983

[51] Int. Cl.[4] ..... B21D 37/16; B21D 43/10

[52] U.S. Cl. ..... 72/342; 72/361; 72/364; 72/422; 219/10.69; 219/10.71; 414/223; 414/226

[58] Field of Search ..... 414/226, 744 A, 223; 294/86 R; 219/10.69, 10.71, 7.5; 72/342, 361, 364, 422

[56] References Cited

U.S. PATENT DOCUMENTS

| | | | |
|---|---|---|---|
| 2,937,017 | 5/1960 | Carbo | 148/150 |
| 3,684,854 | 8/1972 | Nikonov et al. | 219/10.69 |
| 4,109,127 | 8/1978 | Frungel | 219/7.5 |
| 4,220,106 | 9/1980 | Supik | 413/1 |
| 4,450,703 | 8/1984 | McCloskey | 72/342 |

FOREIGN PATENT DOCUMENTS

| | | | |
|---|---|---|---|
| 139142 | 10/1979 | Japan | 219/10.71 |
| 862174 | 3/1961 | United Kingdom | 414/4 |
| 733843 | 5/1980 | U.S.S.R. | 72/422 |

OTHER PUBLICATIONS

Rheocasting, Merton C. Flemings and Kenneth P. Young, McGraw-Hill Yearbook of Science and Technology, pp. 49-58, 1977-1978.

*Primary Examiner*—Lowell A. Larson
*Assistant Examiner*—Jorji M. Griffin

[57] ABSTRACT

Shaped metal parts are produced on a continuous basis from a semisolid metal preform. A plurality of free-standing metal preforms are sequentially heated in an induction heating zone to the semisolid level and transferred without substantial deformation or heat loss to a press where they are shaped in a semisolid state into a shaped metal part.

18 Claims, 4 Drawing Figures

APPARATUS AND PROCESS FOR PRODUCING SHAPED METAL PARTS

This invention relates to an apparatus and process for producing shaped metal parts on a continuous basis.

Vigorous agitation of metals during solidification is known to eliminate dendritic structure and produce a semisolid "slurry structured" material with thixotropic characteristics. It is also known that the viscosities of such materials may be high enough to be handled as a soft solid. See Rheocasting, Merton C. Flemings and Kenneth P. Young, *McGraw-Hill Yearbook of Science and Technology,* 1977–78. However, processes for producing shaped parts from such slurry structured materials, particularly on a continuous basis, present a number of problems. Such processes require a first step of reheating a slurry structured billet charge to the appropriate fraction solid and then forming it while in a semisolid condition. A crucible has been considered essential as a means of containing the material and handling it from its heating through its forming cycle. The use of such crucibles is costly and cumbersome and furthermore creates process disadvantages such as material loss due to crucible adhesion, contamination from crucible degradation and untoward chilling from random contact with crucible side walls. Other problems are involved in the heating, transport and delivery of billets which are in a semisolid condition. It would be desirable to provide an apparatus and process for producing shaped metal parts from semisolid preforms. Such a process would provide considerable manufacturing economy, particularly a process which does not require crucibles or other containing means and which is capable of operation on a continuous basis.

It is a primary object of the present invention to provide an apparatus and process for making shaped metal parts from slurry structured metal preforms on a continuous basis and for the transport and delivery of metal in a partially liquid form without the use of crucibles or containers of any kind.

In accordance with the present invention, it has been found that it is possible to produce on a continuous basis shaped metal parts from slurry structured freestanding metal preforms by sequentially raising the heat content of the preforms as they are passed through a plurality of induction heating zones. The heating sequence is such that it avoids melting and resulting flow and permits thermal equilibration during transfers from one zone to the next as the preforms are raised to a semisolid temperature. The invention provides preforms which are substantially uniformly semisolid throughout each preform. The freestanding semisolid preforms are then transferred to a press or other shaping station by means of mechanical transferring means which grip the preforms with a very low force which both prevents substantial physical deformation of the semisolid preform and reduces heat loss. The transferring means may be heated to even further minimize heat loss of the preforms during transfer.

More specifically, the apparatus of the invention comprises in combination means for supporting and positioning a plurality of slurry structured freestanding metal preforms, said means including means for passing said preforms through a plurality of induction heating zones, heating means containing a plurality of induction heating zones for sequentially raising the heat content of said preforms while the preforms remain freestanding to a level at which the preforms are semisolid, means for transferring said freestanding preforms from said supporting means to a shaping means while the preforms remain in a semisolid state, said transfer occurring without substantial deformation of the preforms and without substantial local variations in fraction solid within the preform, means for shaping said preform while in said semisolid state into a shaped metal part and means for recovering a solidified shaped metal part. The process of the invention comprises supporting and positioning a plurality of slurry structured freestanding metal preforms, passing said preforms into a plurality of induction heating zones for sequentially raising the heat content of said preforms while the preforms remain freestanding to a level at which the preforms are semisolid, transferring said freestanding preforms from said supporting means to a shaping means while the preforms remain in a semisolid state, said transfer occurring without substantial deformation of the preforms and without local variations in fraction solid within the preforms, shaping said preform while in said semisolid state into a shaped metal part and recovering a solidified shaped metal part. In the preferred practice of the invention, the heat content of the preforms is raised at an intermittent rate to the semisolid level over either a portion or the entire heating cycle.

The invention will be better understood by reference to the accompanying drawing in which FIG. 1 is a partially schematic plan view of one embodiment of apparatus useful in the practice of the invention;

The starting preform used in the practice of the present invention is a metal alloy, including but not limited to such alloys as aluminum, copper, magnesium or iron, which has been prepared in such a fashion as to provide a "slurry structure". This may be done by vigorously agitating the alloy while in the form of a liquid-solid mixture to convert a substantial proportion, preferably 30% to 55% by volume, of the alloy to a non-dendritic form. The liquid-solid mixture is then cooled to solidify the mixture. The resulting solidified alloy has a slurry structure. A "slurry structured" material, as used herein, is meant to identify metals having a microstructure which upon reheating to a semisolid state contain primary spherical solid particles within a lower melting matrix. Such slurry structured materials may be prepared without agitation by a solid state process involving the production, e.g. by hot working, of a metal bar or other shape having a directional grain structure and a required level of strain introduced during or subsequent to hot working. Upon reheating such a bar, it will also contain primary spherical solid particles within a lower melting matrix. One method of forming the slurry structured materials by agitation is by use of a rotating magnetic field, such as that disclosed in published British application No. 2,042,386. A preferred method of preparing the preforms is, however, by the solid state process which is disclosed more fully in our copending U.S. application Ser. No. 363,622, filed Mar. 30, 1982. For a more complete description of the preparation of slurry structured preforms useful as starting materials in the present invention, reference should be made to the foregoing published British application or the foregoing copending U.S. application.

Figure 1:
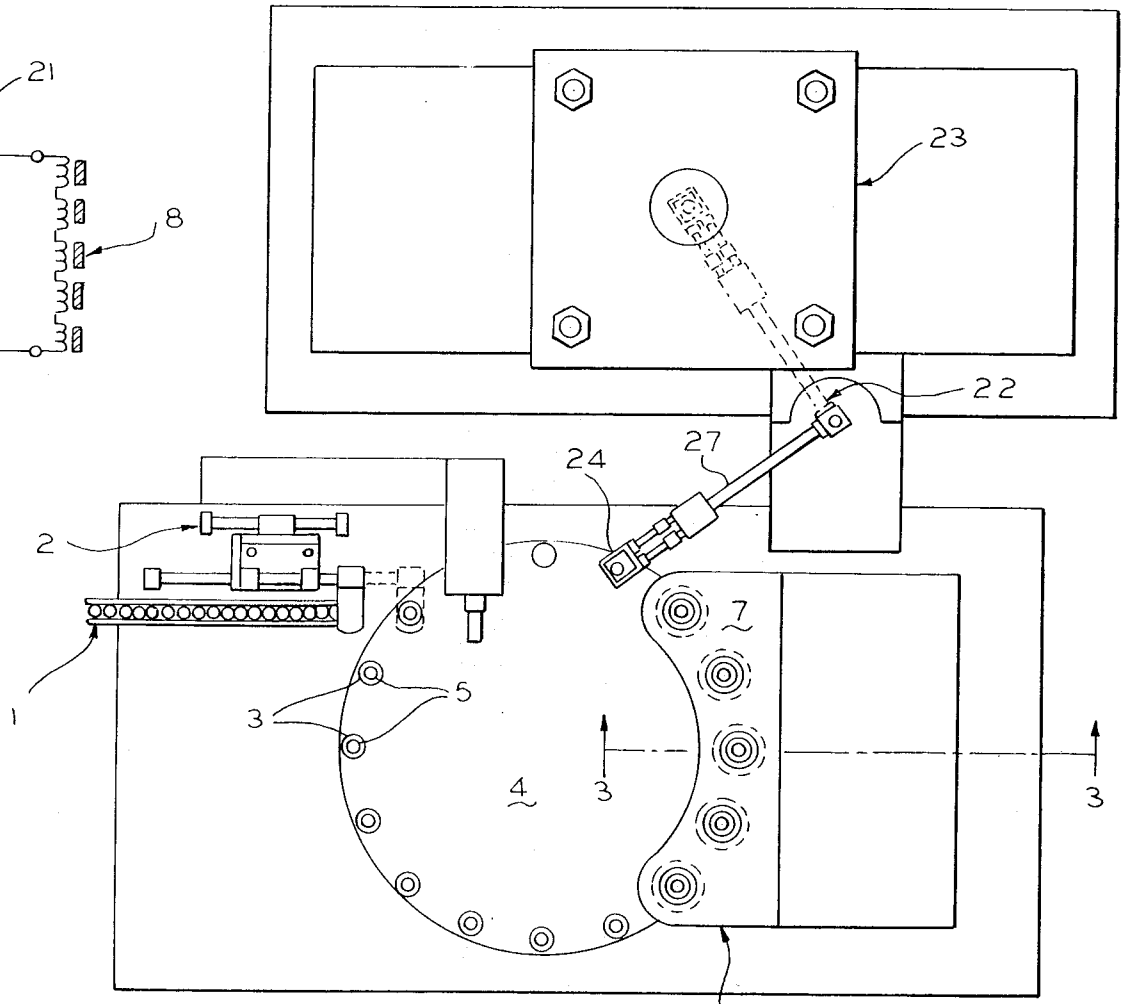
Figure 3:
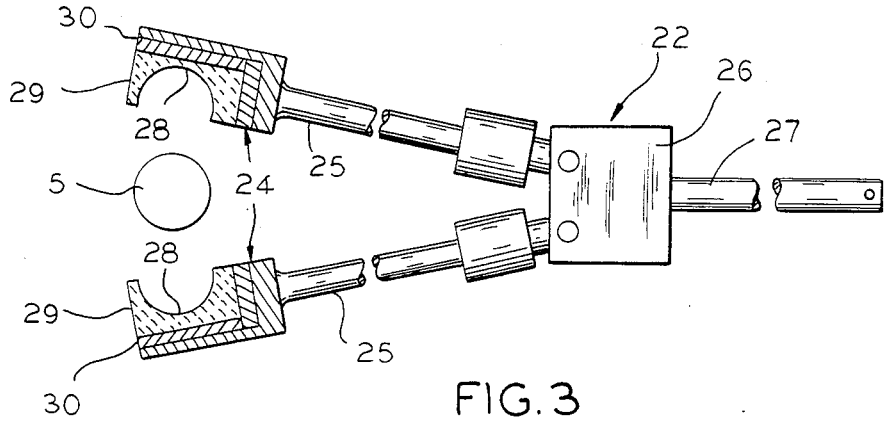
FIG. 3 is an enlarged plan view of the mechanical gripper shown in FIG. 1.

The present invention is particularly useful for the production of relatively small shaped copper or aluminum alloy parts, i.e. parts whose largest dimension is less than six inches. Beyond this size, freestanding preforms become increasingly difficult to handle in a semisolid condition. Starting preforms may therefore conveniently be in the form of cylindrical slugs produced by cutting off suitable lengths of a cast or extruded slurry structured bar. The invention will be illustrated in connection with the use of such slugs. As shown in FIG. 1, such slugs are fed onto a stacker 1 in a single ordered row, as, for example, from a commercially available vibratory bowl feeder (not shown). From stacker 1, they are lifted by a loading dial 2 and placed onto an insulated pedestal 3 on rotatable table 4, the pedestal having a thermal insulator cap 3'. The rotatable table contains around its periphery a series of such insulated pedestals, each of which supports and positions a freestanding metal preform or slug 5. An induction heater 6 is mounted at an opposite side of the rotatable table 4, the induction heater comprising a hood 7 containing a series of coils forming a series of induction heating zones. The induction heater is vertically movable from a first elevated position, as shown in FIG. 3, when table 4 is in process of being indexed to the next consecutive pedestal-preform position to a second descended position in which the induction heating zones enclose a series of adjacent preforms—five in the embodiment shown in the drawing, to raise their heat content. During this period, the horizontal centerline of the preforms should be below the centerline of the coils of the induction heater to avoid levitation of the preforms. Each of the induction heating zones heats the adjacent preforms to a sequentially higher level in the direction of movement of the table 4 so that the preform about to emerge from the induction heater, i.e. in its final position in the heater, is in a uniformly semisolid condition, preferably 70 to 90% by volume solids, remainder liquid. If it is desired to increase the heating rate, the heat content of the preforms should be raised at an intermittent or pulsating rate, over either a portion or the entire heating cycle, preferably at least from the onset of melting of the preform to the final semisolid level. In the first two or three coils, before liquid formation in the preform, the temperature rise may be rapid. In the last two or three coils, the temperature rise may be at a slower rate, at lower power input. This shortens the total time to final temperature without encountering alloy flow problems. In order to accomplish this, the five coils may be wound in series but with a differing number of turns on the various coils. The first two or three coils, those into which the preforms enter first, may be densely wrapped and provide high magnetic flux while the remaining coils are less densely wrapped and provide a lower magnetic or soaking flux.

Figure 4:
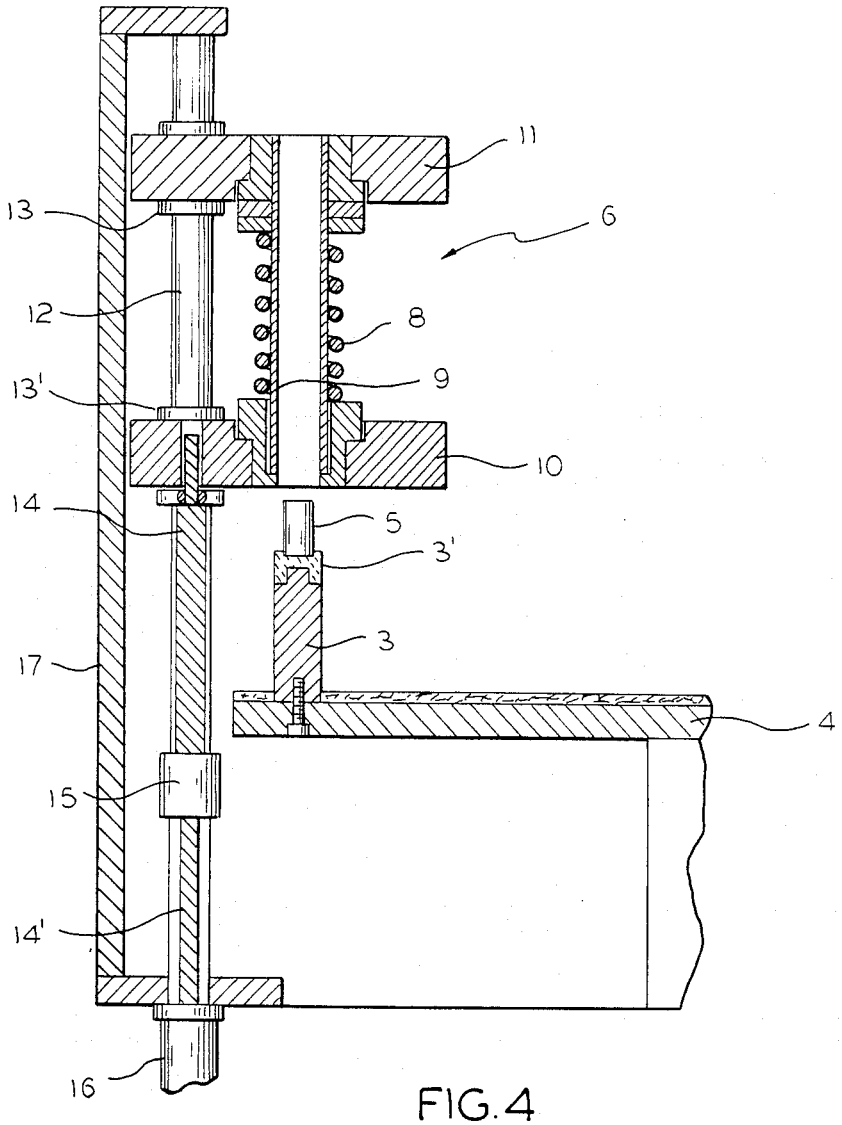
FIG. 4 is a crossectional view of the induction heater in elevated position above the preforms taken along the lines 3—3 of FIG. 1.

The induction heater is shown in greater detail in the crossectional view of FIG. 4. As there shown, the induction heater 6 comprises series wound induction coil 8 having a ceramic liner 9 mounted in a phenolic rack having a bottom support 10 and a top support 11. The heater 6 is in turn mounted for vertical movement on a post 12 via bearings 13 and 13'. Extension rods 14 and 14' are coupled through coupler 15 to an air cylinder 16 for raising and lowering the induction heater 6. The entire assembly is mounted in a frame 17.

Figure 2:
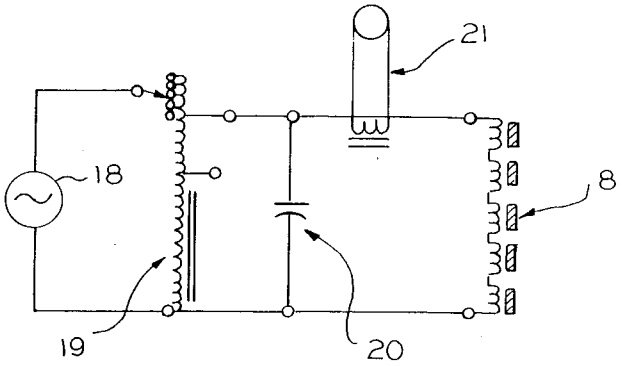
FIG. 2 is a diagram of an electrical circuit for the induction heater shown in FIGS. 1 and 4.

A typical circuit diagram for the induction heater 6 is shown in FIG. 2. As there shown, a high frequency alternating current power source 18 supplies current through a load station consisting of a primary transformer 19, parallel tuning capacitors 20 and an output current transformer 21 to the induction heater 6 comprising five induction coils 8 connected in series.

After the table has indexed a preform from its final position in the heater to a first position external to the heater, a pair of grippers 22 mechanically grips and removes the preform from its pedestal, rotates to a position aligned with the die of a press 23, and deposits the preform on the plates of the press where the preform, in a semisolid state, is shaped into a metal part. The transfer must be carried out under conditions which insure a minimum of deformation of the semisolid preform. The transfer must also create little or no local variation in fraction semisolid (or local heat transfer) within the preform. The grippers are accordingly designed to minimize heat transfer from the preform to the transferring means.

Grippers 22 comprise a pair of gripping jaws 24, preferably containing electrical resistance heating means embedded therein. As shown more clearly in FIG. 3, the gripper jaws are attached to gripper arms 25 which are pivotably mounted for adjustment of the distance therebetween on a gripper actuator 26 which may be an air powered cylinder. The actuator is in turn pivotably mounted on a suitable support through an actuator arm 27 for transferring the preforms from the table 4 to the press 23. The surface 28 of the gripper jaws is machined from a refractory block 29 to have a contour closely matching the contour of the semisolid preform 5. A thermal barrier 30 is sandwiched between the block 29 and gripper jaw 24. Embedded in each of the refractory blocks 29 is an electrical resistance heater rod (not shown) which may be suitably connected to an electrical power source. The grippers jaws are heated to minimize the chilling effect of the gripper material on the semisolid preform. For aluminum alloy preforms, the face of the jaws of the grippers may for example, be plasma sprayed alumina or magnesia; for copper alloys, the face may be a mold washed steel refractory coating or high density graphite. The surface of the gripper may be heated to a temperature substantially above room temperature but below the liquidus temperature of the preforms. The gripping surface of the jaw faces should be maximized so as to minimize deformation of the preform, with the gripper jaw circumference and radius of curvature being close to that of the preform.

The press 23 may be a hydraulic press ranging from 4 to 250 tons equipped with dies appropriate to the part being shaped. The press may be actuated by a commercially available hydraulic pump sized to meet the tonnage requirements of the system. Suitable times, temperatures and pressures for shaping parts from slurry structured metals are disclosed in Canadian Pat. No. 1,129,624, issued Aug. 17, 1982.

The induction heating power supply for the system may range in size from 5 to 550 KW and may operate at frequencies from 60 to 400,000 hertz. The precise power capability and frequency are selected in accordance with the preform diameter and heating rate required. Typically, for example, the power requirement may range from $\frac{1}{4}$ to 1 KW per pound per hour of production required.

The following example illustrates the practice of the invention. Unless otherwise indicated, all parts and percentages are by weight.

EXAMPLE

A copper wrought alloy C360 containing 3.0% lead, 35.5% zinc, balance copper, was extruded and then cold reduced approximately 18% to a 1" diameter to produce a directional grain structure in the bar as more fully described in our aforesaid copending application Ser. No. 363,622. The bar was cut into 1" long×⅝" diameter slugs which were fed to a 16-station rotary indexing table of the type shown in FIG. 1. The slugs were transported from station to station by rotation of the table and pedestals at a rate of 4 indexes/minute. For five consecutive stations the pedestals were surrounded by induction coils raised and lowered in sequence with the index motion so that in the stationary periods the horizontal centerlines of the slugs were located below the centerline or mid-height of each coil. Dwell time in the coil was held to approximately 12 seconds with 3 seconds consumed in transfer motions. The five coils were powered by a 40 KW, 3000 Hz induction unit such that upon exiting the fifth and last coil, the preform was in semi-solid condition, approximately 70% solid and 30% liquid. The temperature of the slugs was raised progressively from 25° C. to 890° C. as it was indexed from the first to the fifth coil. The 3000 Hz alternating current supplied to the coils was held constant such that each coil generated an oscillating magnetic field proportional to the turn density of the coils. The preform from the fifth coil was then gripped by two jaws heated to 900° F. affixed to a gripper of the type shown in FIG. 2 which transferred the assembly to the press whereupon it was released and allowed to drop into the die cavity. The slug was then press forged into a 1" strainer nut using a 12 ton, 4-platen press. The jaws employed were steel insulated on their contact surfaces with plasma sprayed refractory and heated via small electrical cartridge heaters embedded therein. The gripping surface of the jaws was machined so that the contact region had a radius of curvature which matched that of the reheated preform. The preform was then removed from the press and quenched. The pressed part was torque tested to 80 feet pounds which is equivalent to parts machined from wrought bar. The part exhibited a hardness of Rockwell B70 and electrical conductivity of 25% 1 ACS.

We claim:

1. Apparatus for continuously producing shaped metal parts comprising:

means for supporting and positioning a plurality of freestanding metal preforms, heating means, means for indexing said preforms sequentially through said heating means, said heating means comprising a plurality of separate partitioned heating stations for sequentially raising the heat content of said preforms as said preforms pass into and out of each of said heating stations, said preforms remaining free standing and being heated in said heating means to a level at which said preforms become partially liquid and partially solid, means for transferring a freestanding preform from said supporting means to a shaping means while said preform remains substantially in its initial shape and partially liquid-partially solid state, said transferring means being a mechanical gripper having gripping jaws, the surface of which are heated to a predetermined level to minimize heat loss from said preforms to said transferring means, means for shaping said preform while in said partially liquid-partially solid state into a shaped metal part and means for recovering said perform after being solidified into a metal part.

2. The apparatus of claim 1 in which the heating means includes means for raising the heat content of said preforms at an intermittent rate.

3. The apparatus of claim 1 in which the contour of said gripping jaws closely matches the contour of said metal preforms.

4. The apparatus of claim 1 in which the mechanical gripper comprises a pair of gripping jaws mounted for adjustment of the distance therebetween, the preform contacting surface of said jaws being a material capable of withstanding temperatures of at least 400° C., said gripper being movable for transferring said preforms from said supporting means to said shaping means and a power source for movement of said gripper and for adjustment of the distance between said jaws.

5. The apparatus of claim 4 in which the jaws of the mechanical gripper are pivotably mounted for adjustment of the distance therebetween and the mechanical gripper is pivotably mounted for rotation for transferring said preforms from said supporting means to said shaping means.

6. The apparatus of claim 4 in which an electrical resistance heating means is embedded in each of said jaws for raising the temperature of the gripping surface thereof to a predetermined level.

7. The apparatus of claim 1 in which said means for supporting said preforms is a plurality of insulated pedestals.

8. The apparatus of claim 7 in which the means for positioning and passing said preforms into the induction heating zones is a rotatable table upon which said insulated pedestals are mounted.

9. The apparatus of claim 1 in which said heating means is vertically movable from a first elevated position to permit transfer of said preforms into or out of the heating zone to a second descended position to enclose a series of adjacent preforms to raise the heat content thereof.

10. The apparatus of claim 1 in which the induction heating zones of said heating means comprise a plurality of coils wound in series with a differing number of turns, the coils into which said preforms enter first being more densely wrapped than the remaining coils.

11. A process for continuously producing shaped metal parts comprising the steps of:

supporting and positioning a plurality of freestanding metal preforms, indexing said preforms sequentially through a plurality of separate induction heating stations for sequentially raising the heat content of said preforms to a level at which the preforms are partially liquid and partially solid, while the preforms remain free standing and, said preforms pan through each of said heating stations, transferring said freestanding preforms with a mechanical gripper from said supporting means to a shaping means while the preforms remain substantially in their initial shape and partially liquid-partially solid state, said mechanical gripper having gripping jaws, the surface of which are heated to a predetermined level to minimize heat loss from said preforms to said transferring means, shaping said preform while in said partially liquid-partially solid state into a shaped metal part and recovering said preform after being shaped into a solidified metal part.

12. The process of claim 11 in which the heat content of said preforms is raised at an intermittent rate.

13. The process of claim 11 in which the gripping surface of the mechanical gripper is heated to a temperature substantially above room temperature but below the liquidus temperature of the preforms.

14. The process of claim 11 in which the preforms are cylinders.

15. The process of claim 11 in which the preform is a copper or aluminum alloy, the largest dimension of which is less than six inches.

16. The process of claim 11 in which the preforms when heated to the partially liquid-partially solid level are substantially uniformly semisolid and contain from 70 to 90% by volume solids.

17. The process of claim 11 in which the horizontal centerline of the preforms while in the induction heating zones remains below the corresponding centerline of the induction heating zones.

18. The process of claim 11 in which the heat content of said preforms is raised more rapidly in the first heating zones into which they are passed than in the remaining heating zones.

* * * * *